United States Patent [19]

Jaffa

[11] 3,930,445

[45] Jan. 6, 1976

[54] SQUEEGEE ASSEMBLY FOR USE ON A SCREEN PRINTING MACHINE

[75] Inventor: David Jaffa, Fairlawn, N.J.

[73] Assignee: Precision Screen Machines, Inc., Hawthorne, N.J.

[22] Filed: Mar. 14, 1974

[21] Appl. No.: 451,054

[52] U.S. Cl. ..... 101/120; 101/123; 101/124; 101/157; 101/169

[51] Int. Cl.[2] ..... B41F 15/42; B41F 15/46

[58] Field of Search ..... 101/116, 119, 120, 169, 101/157, 123, 124, 365; 15/256.5, 256.51

[56] References Cited

UNITED STATES PATENTS

| | | | |
|---|---|---|---|
| 2,274,166 | 2/1942 | Roesen | 101/365 |
| 2,928,340 | 3/1960 | Stein et al. | 101/120 |
| 3,029,779 | 4/1962 | Hornbostel | 101/119 UX |
| 3,110,919 | 11/1963 | Barnby | 101/120 UX |
| 3,735,730 | 5/1973 | Mitter | 101/119 X |
| 3,795,188 | 3/1974 | Giani | 101/119 |

FOREIGN PATENTS OR APPLICATIONS

| | | | |
|---|---|---|---|
| 432,955 | 8/1926 | Germany | 101/169 |

*Primary Examiner*—Edgar S. Burr
*Assistant Examiner*—R. E. Suter
*Attorney, Agent, or Firm*—Philip D. Amins

[57] ABSTRACT

A squeegee assembly for use on a screen printing machine which includes a squeegee holder and associated squeegee blade having a liquid filled tubular member for exerting a liquid or hydraulic pressure on the squeegee blade in a manner whereby the pressure exerted by the squeegee blade is equalized along the entire length thereof and to provide the squeegee blade with the flexibility necessary to conform to a printing surface. The assembly may also include a piston and cylinder assembly to vary the liquid pressure exerted on the squeegee blade and/or a contour bar through which the liquid pressure is transmitted to the squeegee blade.

3 Claims, 8 Drawing Figures

SQUEEGEE ASSEMBLY FOR USE ON A SCREEN PRINTING MACHINE

PROBLEM

In high speed rotary screen printing machines, a metal squeegee blade is frequently utilized to force the ink or color through a rotating screen during a printing operation. However, some difficulty has been encountered in maintaining the pressure exerted by the squeegee blade equalized throughout the length thereof during a printing operation, and at the same time to impart to the squeegee blade the requisite flexibility to conform to any irregularities of the printing bed or surface. Unless the pressure exerted by the squeegee blade is equalized across the length thereof, a non-uniform print results therefrom.

OBJECTS

It is an object of this invention to provide an improved squeegee assembly in which a liquid pressure is exerted along the length of the squeegee blade to equalize the pressure exerted thereby.

Another object is to provide a squeegee assembly in which the liquid pressure is exerted along the length of the squeegee blade in a manner whereby the squeegee blade is provided with the flexibility necessary to conform to the printing surface.

Another object is to provide a squeegee assembly which is subjected to a liquid pressure in which the amount of applied liquid pressure can be readily adjusted.

BRIEF SUMMARY OF THE INVENTION

The foregoing object and other features and advantages are attained by a squeegee assembly comprising a squeegee holder and an associated squeegee blade. Supported on the squeegee holder for exerting a liquid or hydraulic pressure is a tubular member containing a supply of liquid. The arrangement is such that the liquid filled tubular member maintains a liquid pressure in the squeegee blade along the length thereof. The tubular member may be formed to contain a confined amount of liquid, or alternatively may be connected to a reservoir in the form of a piston and cylinder whereby the pressure exerted by the tubular member can be adjusted within predetermined limits. In another embodiment of the invention a contour bar may be interposed between the liquid filled tubular member and the squeegee blade whereby the liquid pressure is transmitted through the contour bar to the squeegee blade. The contour bar is formed with a tapered edge to engage the squeegee blade along a line contact so that by reversing the contour bar the squeegee blade can be made hard or soft accordingly. Also, the contour bar is provided with a plurality of spaced slots to impart the contour bar with the requisite flexibility to conform to a printing bed or surface during a printing operation.

FEATURES

A feature of this invention resides in the provision of a squeegee assembly having a liquid filled tubular member for exerting a liquid pressure on the end of a squeegee blade so that the pressure exerted by the squeegee blade is equalized throughout the length thereof.

Another feature of this invention resides in the provision of interposing a contour bar between a liquid filled tubular member and the squeegee blade whereby the liquid pressure is transmitted through the contour bar to the squeegee blade.

Another feature of this invention resides in the provision of a contour bar for equalizing the fluid pressure transmitted to a squeegee blade which is slotted so as to provide the requisite flexibility to permit the squeegee blade to conform to the contour of a printing surface or bed.

Another feature resides in the provision of a squeegee assembly which is subjected to a liquid pressure which can be readily varied so as to adjust the pressure the squeegee blade exerts on the printing screen.

Another feature of this invention resides in the provision of a squeegee holder formed to accommodate a liquid filled tubular member for exerting liquid pressure onto a squeegee blade to equalize the pressure exerted thereby along the length of the squeegee blade.

Other features and advantages will become more readily apparent when considering in view of the drawings in which.

DETAILED DESCRIPTION

Figure 1:
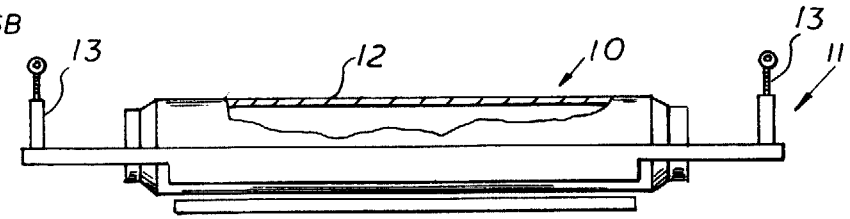
FIG. 1 illustrates a diagramatic elevation view of a squeegee assembly embodying the present invention as applied to a rotary screen printing machine.

Referring to the drawings, there is shown in FIG. 1, a squeegee assembly 10 embodying the present invention as applied to a rotary screen printing apparatus 11. As shown, squeegee assembly 10 is axially disposed to extend through a rotary printing screen 12. In such screen printing apparatus 12, e.g., as described in patent application Ser. No. 268,522 filed July 3, 1972, means are provided for raising and lowering the screen and associated squeegee assembly between a printing and non-printing position. As shown, diagramatically, the squeegee assembly is also provided with adjusting means 13 whereby the force which the squeegee assembly exerts on a printing screen can be varied. Such adjusting means may comprise either a mechanical and/or hydraulically operated means, e.g., a piston and cylinder assembly. Such means 13—13 initially locate the squeegee assembly 10 relative to the printing screen 12 during a printing operation.

In accordance with this invention, there is provided an additional means whereby the pressure exerted by the squeegee blade on the screen can be uniformally applied or distributed across the entire length of the squeegee blade from selvage to selvage edge of the material being printed. The squeegee assembly 10 comprises a squeegee holder 14 which is suitably supported on a support bar 15 extending axially of a rotary printing screen 12. The squeegee holder 14, as illustrated, comprises a casting, extrusion or other suitable formed member having opposed depending side walls portions 14A — 14B to define an inverted channelway 16. Connected to one of the side wall portions, e.g., 14B, is a bracket 17 for securing a squeegee blade 18 to the holder 14. The squeegee blade 18 may be formed of a thin flexible metal sheet, as for example, copper, whereby the free end 18A of the blade underlies the channelway 16 defined by the opposed side wall portions 14A, 14B of the squeegee holder 14.

Interposed and arranged to extend within the channelway 16 defined by the opposed side wall portions 14A, 14B of the squeegee holder 14 is a flexible tubular member 19. In the embodiment illustrated in FIGS. 2 and 3, the tubular member is filled with a liquid, e.g., water or other suitable hydraulic fluid 20 and which tubular member is sealed at both ends, as indicated at 21. Thus, the water or other suitable hydraulic liquid 20 is confined within the sealed tubular member 19 in a manner whereby a liquid pressure is applied onto the end of the squeegee blade 18 when the squeegee blade 18 is disposed in printing position.

Figure 3:
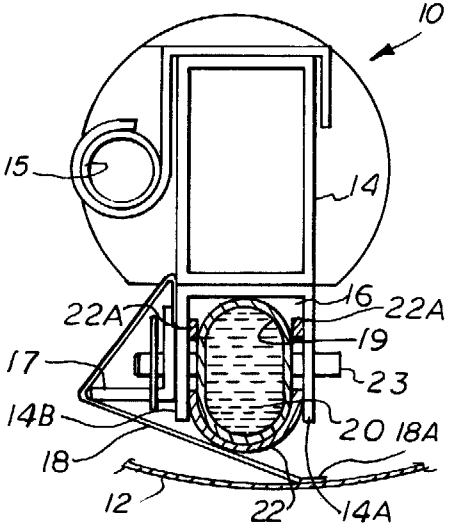
FIG. 3 is a sectional view taken along line 3—3 on FIG. 2.
Figure 2:
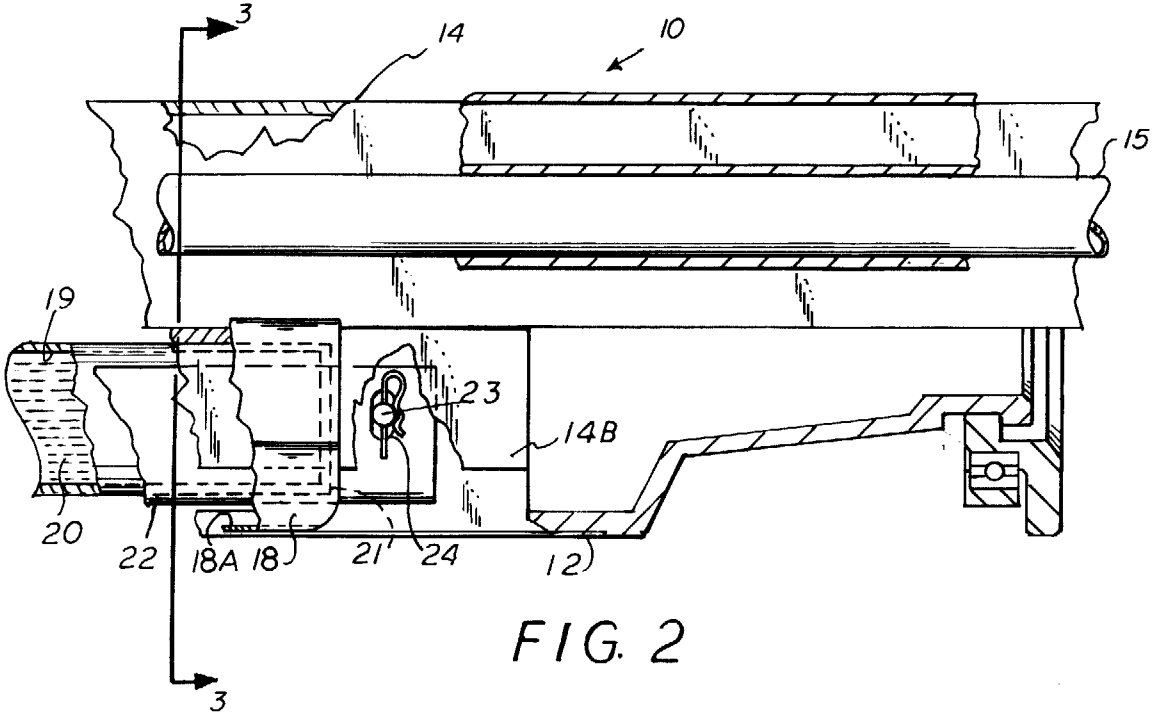
FIG. 2 is a fragmentary elevation view of a squeegee assembly embodying the present invention.

As best seen in FIGS. 2 and 3, the tubular member filled with the hydraulic liquid is retained within the channelway 16 by a cradle 22 formed of a flexible material, e.g., Teflon or other suitable material. The cradle material is arranged to conform to the shape of the tubular member 19 and the sides 22A, 22A are supported between the side wall portions 14A, 14B of the holder by transversely extending pins 23 located at each end of the cradle 22. As best seen in FIG. 2, the sides 22A of the cradle are provided with an elongated hole 24 through with the support pin 23 extends. The slotted hole 24 permits some limited lost motion of the Teflon cradle so as to permit it to adapt to the tubular member 19 when the latter is exerting pressure on the squeegee blade 18.

The arrangement is such that when the squeegee assembly 10 is initially lowered to the printing screen, that the deflection of the squeegee blade 18 against the liquid filled tubular member 19 is such that a hydraulic or liquid pressure is exerted along flexible end 18A of the squeegee blade 18 during a printing operation. In this manner, the pressure exerted by the squeegee along its entire width against the printing screen is equalized. The liquid filled tubular member 19 also enables the squeegee blade to achieve the desired flexibility so as to maintain contact with the printing screen throughout the entire length thereof during a printing operation thereby resulting in a uniform print.

Figure 4:
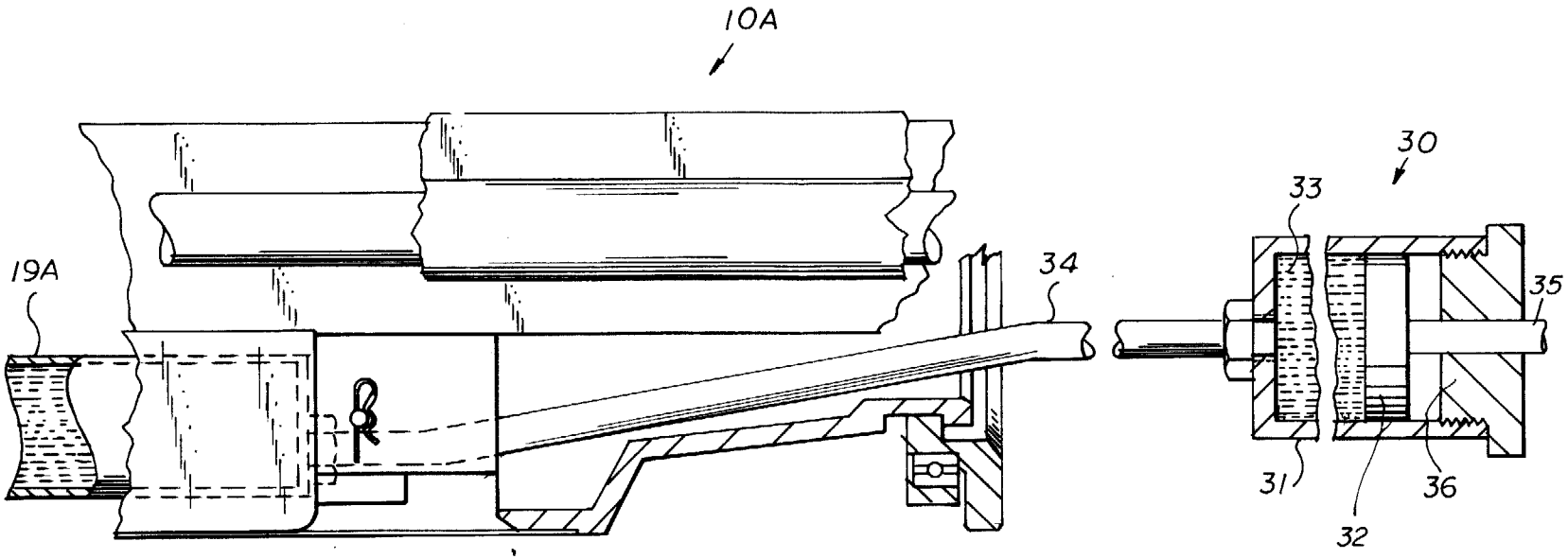
FIG. 4 is a fragmentary elevation view similar to that of FIG. 2, but illustrating a modified embodiment thereof.

FIG. 4 illustrates a modified embodiment of the invention. In this form of the invention, the squeegee assembly 10A is identical to squeegee assembly 10 described with respect to FIGS. 2 and 3, with the exception that the tubular member 19A is connected in fluid communication with a reservoir means 30 whereby the liquid pressure exerted by the liquid filled tubular member can be adjusted or varied. In the illustrated embodiment, the reservoir comprises a cylinder assembly 31 having a piston 32 moveably mounted therein. Thus the piston 32 defines with the end wall of the cylinder 31 a reservoir for containing a supply of liquid 33. A connecting conduit 34 connects the liquid chamber of the cylinder in fluid communication with the tubular member 19A. It will be understood that the piston 32 which is moveably mounted within the cylinder is provided with suitable sealing means to prohibit any leakage of the liquid thereby. An adjusting stem 35 is connected to the piston 32; the adjusting stem 35 being threaded to an end nut 36 so that rotation of the adjusting stem 35 in one direction or another causes the piston 32 to be moveably displaced within the cylinder. By rotating the adjusting stem in one direction or the other, the piston 32 is moved relative to the cylinder 31 to adjust the fluid pressure exerted upon the walls of the tubular member 19A.

Figure 5:
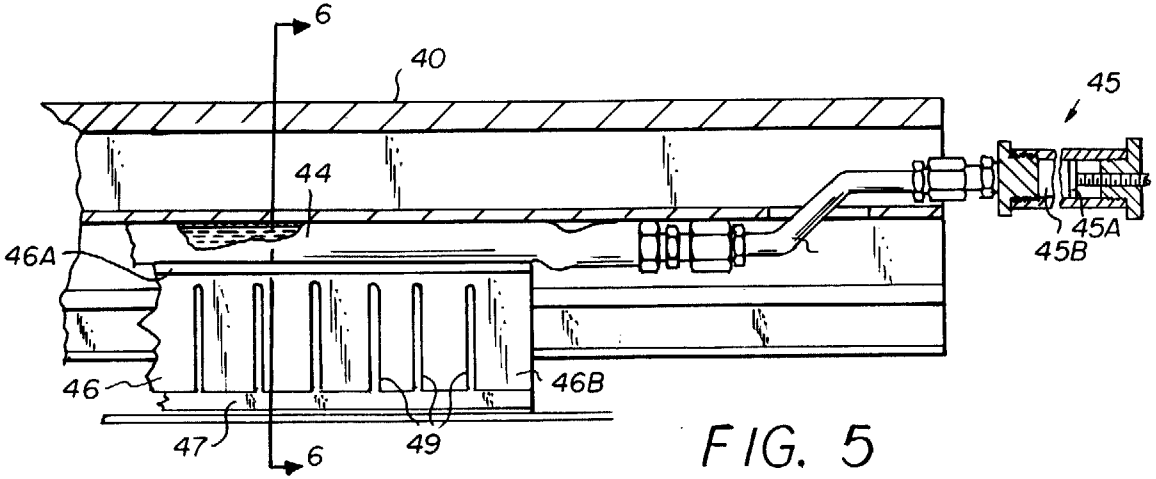
FIG. 5 is a fragmentary elevation view of another embodiment of the invention having portions thereof broken away.
Figure 7:
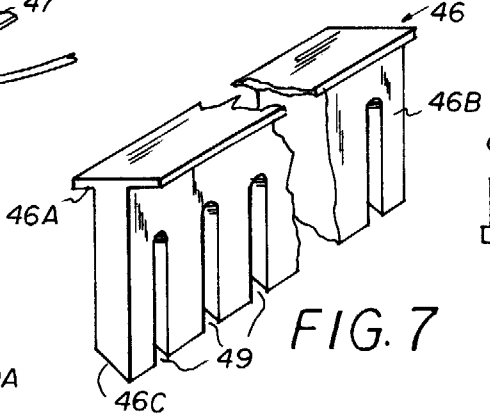
FIG. 7 is a detailed perspective view of a contour bar utilized in the embodiment of the invention shown by FIGS. 5 and 6.
Figure 6:
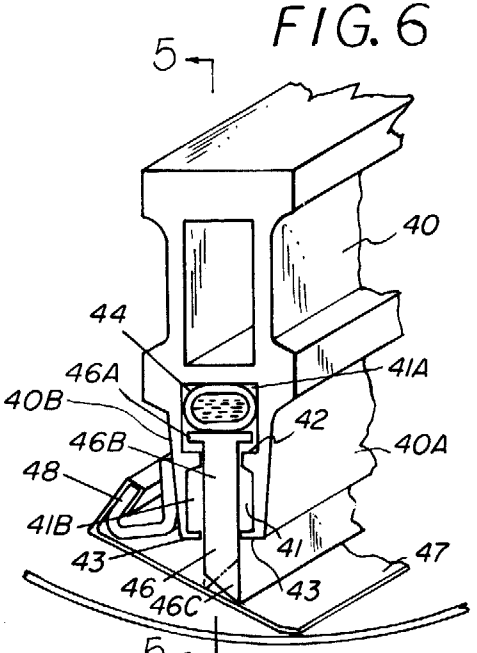
FIG. 6 is a sectional perspective view taken along line 6—6 on FIG. 5 drawn to an enlarged scale.

FIGS. 5, 6, and 7 are directed to another embodiment of the invention. In this form of the invention, the squeegee holder 40 comprises a casting, extrusion or similar formed member having depending opposed side wall portions 40A, 40B defining a channelway 41 extending therealong. As best seen in FIG. 6, a pair of spaced apart longitudinally extended ribs 42 and 43 are formed along the opposed side wall portions 40A, 40B to define an upper channelway 41A and a lower channelway 41B. In this form of the invention, a liquid filled tube 44 is confined within the upper channelway portion 41A. As previously described, with respect to FIG. 4, the liquid filled tube comprises a flexible tubular member 44 filled with suitable liquid. The member 44 is connected in fluid communication with a reservoir in the form of a piston and cylinder assembly 45, by means of a connecting conduit 39. Thus, the liquid pressure exerted on the walls of the tubular member 44 can be varied by effecting adjustment of a piston 45A relative to a cylinder 45B, in a manner similar to that described with respect to FIG. 4. However, in this form of the invention, a contour bar 46 is interposed between the liquid filled tubular member 44 and the squeegee blade 47, the latter being secured upon a bracket 48 which is in turn connected to the holder 40.

As best seen in FIGS. 6 and 7, the contour bar 46 may be formed of any suitable semi-rigid material, e.g., flexible plastic, Teflon and the like. The contour bar is formed with a generally T-shaped cross section in which the cross arm portion 46A is disposed within the upper channelway 41A to engage the liquid filled tubular member 44. The blade portion 46B extends between the longitudinally extending ribs 42, 43 so that the lower end of the contour bar engages the free end of the squeegee blade 47. It will be apparent that the pressure exerted by the liquid confined within the flexible tube 44 is transmitted through the contour bar 46 to the free end of the squeegee blade 47.

As shown in FIGS. 6 and 7, the lower or tip end portion 46C of the contour bar is tapered so as to define a sharp edge for defining a line contact with the squeegee blade 47. The arrangement is such that by reversing the contour bar, the tip end of the squeegee blade can be made hard or soft, i.e., the bearing line at which the contour bar engages the squeegee blade can be changed by reversing the blade as indicated by the dotted line showing in FIG. 6.

The contour bar 46 is also provided with a plurality of longitudinally spaced slots 49 which extend along the blade portion. The slots 49 enable the contour bar 46 to be longitudinally flexed so that during a printing operation, the pressure is equalized along the length of the squeegee blade and at the same time enables the squeegee blade 47 to conform to the printing surface to result in a uniform screen print.

In all other respects the operation of the squeegee assembly illustrated in FIGS. 5 and 6 is similar to that described with respect to the squeegee assembly of FIG. 4.

Figure 8:
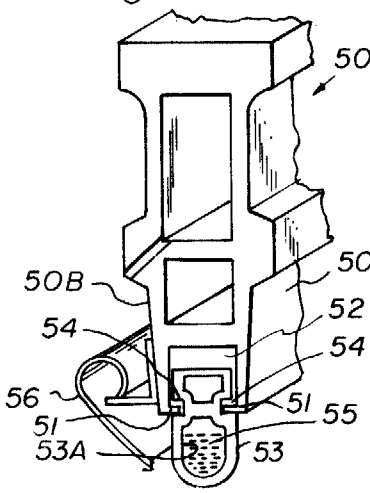
FIG. 8 is a perspective sectional view of another modified form of the invention.

FIG. 8 illustrates another embodiment of the invention. In this form, the squeegee holder 50 comprises a casting, extrusion or otherwise formed member having depending side wall portions 50A, 50B which terminate in an inturned flange 51 defining a channelway 52. A flexible tubular member 53 is partially disposed in the channelway. The tubular member 53 may be formed of plastic, rubber or the like, and its wall structure is formed with opposed longitudinally extending grooves 54 which are adapted to receive the inturned flanges 51 to support the tubular member 53 on the holder 50.

As seen in FIG. 8, the tubular member 53 is provided with a chamber portion 53A for containing the confined liquid which exerts the fluid pressure upon the associated squeegee blade 56. In all other respects the operation of the squeegee assembly 50 of FIG. 8 is similar to that described with respect to FIGS. 1 and 2.

From the foregoing it will be apparent that the liquid filled tubular members 19, 19A, 44 and 53 of the respective described embodiments function to maintain an equalized pressure on the squeegee blade along the entire length thereof. Also, the arrangement enables the squeegee blade to conform to any irregularities of the printing surface while at the same time maintaining equalized pressure across the squeegee blade. The utilization of the contour bar of FIGS. 5 to 7 enables the pressure to be maintained along the length of the squeegee blade without placing the tubular member in contact with the squeegee blade. Thus, the liquid filled tube of FIGS. 5 to 7 is spaced from the printing ink. Also with the construction of FIGS. 5 to 7, the flaccidity of the squeegee blade can be adjusted by reversing the contour bar so as to shift the line contact thereof with the squeegee blade.

While the instant invention has been described with respect to several embodiments thereof, it will be readily understood and appreciated that variations and modifications may be formed without departing from the spirit or scope of the invention.

What is claimed is:

1. A squeegee assembly for use on a screen printing machine comprising means for holding a squeegee, a squeegee blade supported on said squeegee holding means, means for maintaining a hydraulic pressure on said squeegee blade, means for adjusting the hydraulic pressure created on said squeegee blade, said means for maintaining hydraulic pressure including a flexible tube sealed at one end, a supply of liquid contained within said tube, a reversibly positionable contour bar interposed between said squeegee blade and said tube, said contour bar having an inclined bottom surface terminating in a sharp bearing edge for engaging the free end of said squeegee blade, and said contour bar having a plurality of spaced apart slots formed therein, said slots opening toward the bearing edge of said contour bar so as to equalize the pressure applied through said contour bar on said squeegee blade, whereby the flaccidity of said squeegee blade can be adjusted by an end-for-end reversing of said contour bar.

2. A squeegee assembly for use on a screen printing machine comprising:

means for holding a squeegee having opposed side wall portions defining a channelway therethrough, a squeegee blade connected to said holding means, said squeegee blade having its free end extending under said channelway, a flexible tubular member disposed in said channelway, said tubular member being sealed at one end, a cylinder assembly, a conduit connecting said cylinder assembly in communication with said tubular member, a piston disposed within said cylinder assembly, means for adjusting said piston relative to said cylinder assembly, a liquid supply confined to said tubular member, cylinder assembly and connecting conduit whereby the adjustment of said piston varies the pressure of said liquid supply acting on said tubular member, and a reversibly positionable contour bar interposed between said tubular member and said squeegee blade whereby the liquid pressure within said tubular member is transmitted through said contour bar to said squeegee blade, said contour bar having a tapering end portion to define a sharp edge forming a line contact with said squeegee blade whereby the distance of said line contact from the edge of the free end of the squeegee blade can be varied by end-for-end reversing of said contour bar to thereby adjust the flaccidity of said squeegee blade.

3. The invention as defined in claim 2, wherein said contour bar has a plurality of spaced slots formed therein, and said slots opening to the squeegee engaging edge portion.

* * * * *